United States Patent [19]

Humphrey

[11] 4,177,898

[45] Dec. 11, 1979

[54] GIFT WRAP PACKAGE

[75] Inventor: Robert J. Humphrey, Bennington, Vt.

[73] Assignee: Avco Corporation, Greenwich, Conn.

[21] Appl. No.: 937,651

[22] Filed: Aug. 28, 1978

[51] Int. Cl.[2] ..... B65D 69/00

[52] U.S. Cl. ..... 206/494; 206/45.33; 206/459; 229/DIG. 4

[58] Field of Search ..... D59/2 C; 206/45.33, 206/49, 215, 410, 425, 449, 459, 492, 494; 221/46, 48, 55, 63; 282/1 R; 229/87 R, 87 A, DIG. 4

[56] References Cited

U.S. PATENT DOCUMENTS

| | | | |
|---|---|---|---|
| 1,028,084 | 5/1912 | Bond | 206/494 |
| 1,942,673 | 1/1934 | Weiner | 206/494 X |
| 2,138,425 | 11/1938 | Morris | 206/494 |
| 2,471,145 | 5/1949 | Erikson | 206/494 |
| 3,865,234 | 2/1975 | Kester | 206/492 X |
| 4,064,990 | 12/1977 | Bennett | 206/449 X |

FOREIGN PATENT DOCUMENTS

| | | | |
|---|---|---|---|
| 11834 | 1/1933 | Australia | 206/492 |

*Primary Examiner*—Steven E. Lipman
*Attorney, Agent, or Firm*—Irwin P. Garfinkle

[57] ABSTRACT

A sheet gift wrap package is comprised of two identical nests of folds positioned in a transparent plastic bag in back-to-back relationship. Each fold is comprised of at least two sheets of decorative gift wrap, the sheets being arranged in each fold so that a portion of each sheet is visible in the nests.

3 Claims, 10 Drawing Figures

FIG. 1
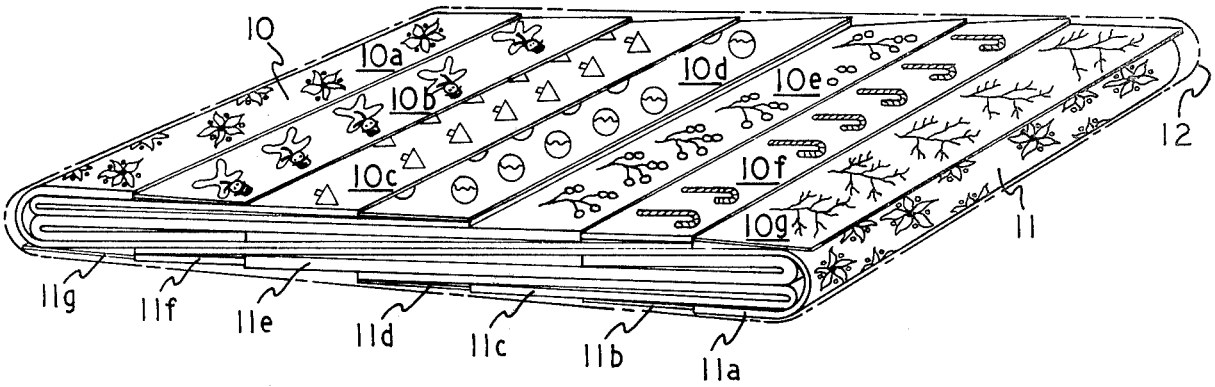
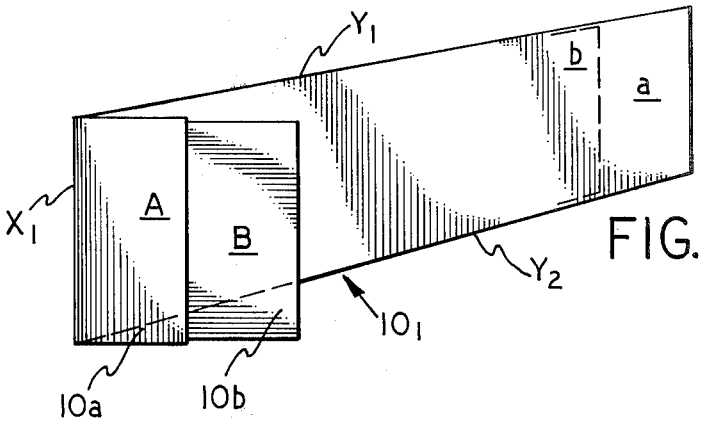
FIG. 2
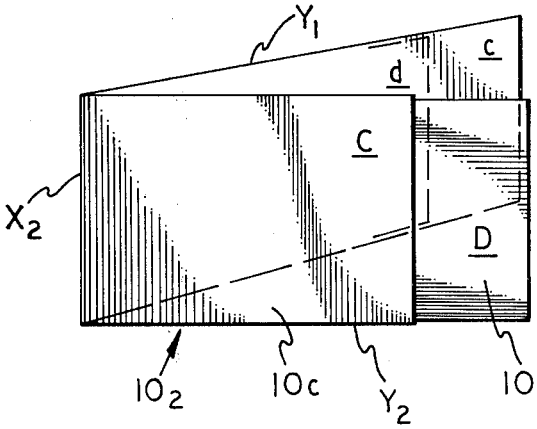
FIG. 3
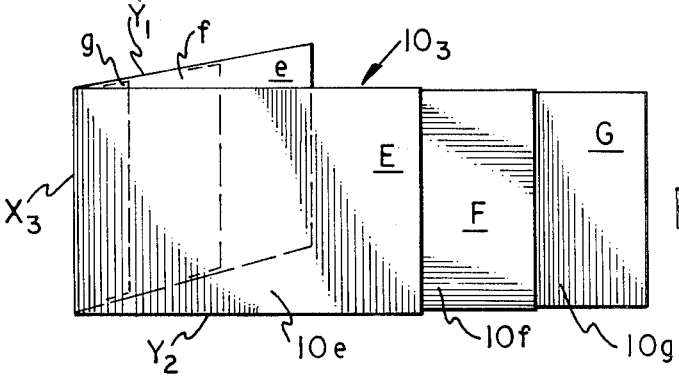
FIG. 4

GIFT WRAP PACKAGE

BACKGROUND OF THE INVENTION

This invention is an improvement over the "Package For Wrapping Paper" disclosed by Bennett in U.S. Pat. No. 4,064,990 issued Dec. 27, 1977. The Bennett package consisted of four nested folds of wrapping paper, each fold comprising at least one sheet. The nesting of the folds is such that a portion of each fold is visible for display. It is noted by Bennett that each fold is formed from two sheets but that the number of sheets of decorative paper may vary in accordance with such factors as weights, type of paper and the total quantity of the paper to be included. In practice, I have found that a single sheet when folded is creased more sharply than is desirable for a neat gift wrap when the paper is unfolded by the user. As a minimum, two sheets are required for each fold.

Bennett has four visible folds in each nest, and two nests are packaged back-to-back in a transparent bag. Thus, Bennett can display a total of eight designs, four in each nest. In accordance with this invention, I modify the Bennett arrangement so that each sheet in each fold is displayed. If the two nests have sheets with identical designs, then it is immaterial which nest is up or down when displayed in a clear transparent bag for sale in the retail store.

DESCRIPTION OF THE PRIOR ART

The only known relevant prior art is Bennett U.S. Pat. No. 4,064,990 and a Kaycrest advertising brochure found in the Bennett file wrapper. Both Bennett and the brochure show packages which display the designs of multiple folds arranged in nests. Neither shows a package in which each sheet in each fold is displayed and which includes two identical back-to-back nests of folds, so that all the designs within the package are displayed from both the top and bottom of the package.

BRIEF DESCRIPTION OF THE DRAWINGS

FIG. 1 is a perspective view showing two nests in back-to-back relationship within a transparent plastic bag.

FIGS. 2, 3 and 4 show the construction of the outer, center and inner folds which together comprise a single nest.

DESCRIPTION OF THE ILLUSTRATED EMBODIMENT

In accordance with this invention, fourteen individual sheets of gift wrap paper are arranged in identical nests 10 and 11 and positioned in a transparent plastic bag 12. The nests are arranged in back-to-back relationship so that the front side of both nests are visible. As can be seen in FIG. 1, approximately equal portions of each design of each sheet in nest 10 is visible through the bag 12.

Since the nests 10 and 11 contain an identical arrangement of sheets 10*a*–10*g* and 11*a*–11*g*, respectively, only the construction of the nest 10 is described in detail. FIGS. 2, 3 and 4 show the three folds $\mathbf{10}_1$, $\mathbf{10}_2$ and $\mathbf{10}_3$ which comprise the nest 10.

As seen in FIG. 2, the fold $\mathbf{10}_1$ is formed of two identical sheets $\mathbf{10}_a$ and $\mathbf{10}_b$ folded together so that the approximately equal-sized portions of their front panels A and B are both visible. Similarly, as seen in FIG. 3, the front panels C and D are both visible, and in FIG. 4 the front panels E, F and G are all visible. When assembled in a nest, the visible portions A–G are all approximately equal in size.

Figure 5:
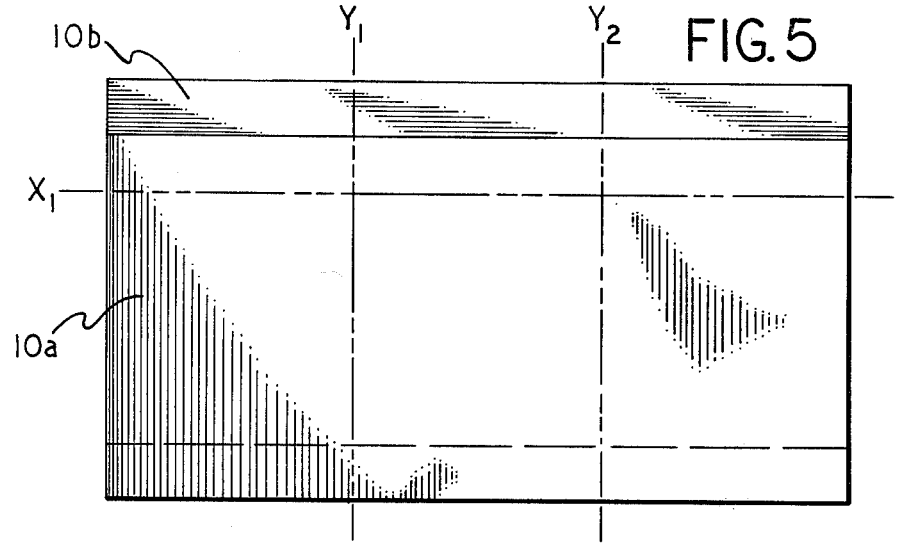
FIGS. 5, 6 and 7 show the flat gift wrap sheets aligned for folding.
Figure 5A:
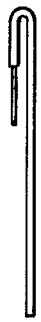
FIGS. 5*a*, 6*a* and 7*a* show an end view of the sheets in FIGS. 5, 6 and 7 after folding.
Figure 6:
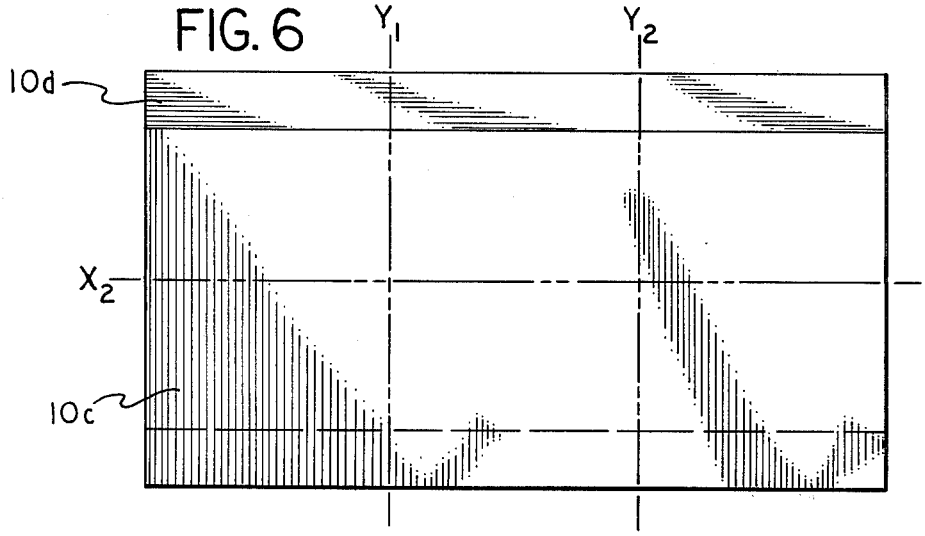
Figure 6A:
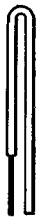
Figure 7:
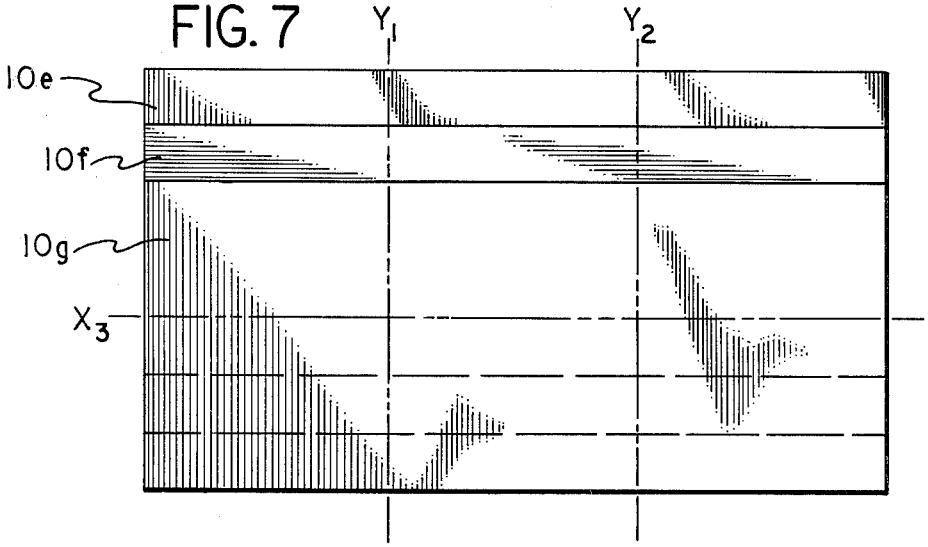
Figure 7A:
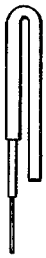

To form a fold, such as the fold $\mathbf{10}_1$, two sheets of paper $\mathbf{10}_a$ and $\mathbf{10}_b$ are placed one upon the other as shown in FIG. 5. The sides of the sheets are aligned widthwise, but the ends are misaligned lengthwise so that approximately two inches of the bottom sheet $\mathbf{10}_b$ is visible under the top sheet $\mathbf{10}_a$. The two sheets $\mathbf{10}_a$ and $\mathbf{10}_b$ are folded together lengthwise about axis lines $Y_1$ and $Y_2$ to form an assembly having dimensions approximately equal to $\frac{1}{3}$ the width of the unfolded sheets and approximately two inches longer than a single sheet. The assembly is then folded along axis line $X_1$ so that the line $X_1$ becomes the backbone of the fold $\mathbf{10}_1$. The backbone $X_1$ divides each fold into front and rear panels. The front panel, consisting of portions A+B, of fold $\mathbf{10}_1$ is formed so that it is substantialy shorter than its complementary rear panel consisting of portions a+b.

The other folds $\mathbf{10}_2$ and $\mathbf{10}_3$ are the same as fold $\mathbf{10}_1$ except that the locations of the axis lines $X_2$ and $X_3$ are located to make the front panels C+D and E+F+G successively longer, and the rear panels c+d and e+f+g successively shorter. Moreover, the fold $\mathbf{10}_3$ contains three sheets rather than two so that the total of seven sheets are included in each nest.

The folds $\mathbf{10}_1$, $\mathbf{10}_2$ and $\mathbf{10}_3$ are assembled with their backbones $X_1$, $X_2$ and $X_3$ in abutment and with the smaller front panels A+B located outwardly of the successively larger front panels C+D and E+F+G. Because of this arrangement, all seven panels, portions A through G, are visible.

The nests 10 and 11 are assembled back-to-back with their backbones at opposite sides of the bag 12. This arrangement serves to make all fourteen panels visible. In addition it provides a substantially uniform cross-section for the package and makes immaterial which side of the package is up or down in the display case.

This invention is subject to many variations within its scope. For example, each fold may include any number of sheets, and a nest may be made up of any number of folds depending on the practical limits of the package dimensions, or all the folds may be made up of only two sheets, etc. Furthermore, the sheets may be made of paper or plastic or any other suitable gift wrap material. It is intended therefore that this invention be limited only by the following claims as interpreted in the light of the prior art.

Moreover, the nests need not be positioned back to back, but one may be inserted within the other, with their back-bones at opposite ends. If the back panels of both nests are facing in the same direction, the back of the package will display the same one design of both nests. This may be preferable for certain displays. Moreover, I have found that the insertion provides an interlock between the nests to reduce the amount of movement between them.

I claim:

1. In a gift wrap package having first and second identical nests of a plurality of folds of gift wrap sheets, each fold comprising at least two sheets of gift wrap, the sides of the sheets in each of said folds being aligned widthwise, said folds being folded on at least one Y axis parallel to the sides, the improvement comprising:

the ends of said sheets in each fold being misaligned lengthwise so that an end portion of each sheet in each fold is visible, each of said folds being folded on an X axis transverse to the sides to provide a front panel and a rear panel, whereby a portion of each sheet of said fold is visible within said front panel, said folds being nested within one another with the Y axis of all the folds being aligned, the front panel of the innermost folds being longer than the front panels of the outermost folds, whereby all of said end portions of said front panels are visible.

2. The invention as defined in claim 1 wherein said nests are positioned in back-to-back relationship within a transparent bag.

3. The invention as defined in claim 2 wherein the X-axes of said nest are on opposite side of said package.

* * * * *